US008819985B1

(12) United States Patent
McCoy et al.

(10) Patent No.: US 8,819,985 B1
(45) Date of Patent: Sep. 2, 2014

(54) SIGHT LEVEL FOR FIREARM

(76) Inventors: Charles A. McCoy, Bellingham, WA (US); James A. Tryon, Seattle, WA (US)

( * ) Notice: Subject to any disclaimer, the term of this patent is extended or adjusted under 35 U.S.C. 154(b) by 144 days.

(21) Appl. No.: 12/973,567

(22) Filed: Dec. 20, 2010

Related U.S. Application Data

(60) Provisional application No. 61/284,480, filed on Dec. 21, 2009, provisional application No. 61/403,551, filed on Sep. 17, 2010.

(51) Int. Cl.
*F41G 1/00* (2006.01)

(52) U.S. Cl.
USPC ..... 42/111; 42/1.01; 33/373; 33/384

(58) Field of Classification Search
USPC ..... 42/1.01, 111; 33/379, 380, 383, 384, 33/370, 371, 372, 373
See application file for complete search history.

(56) References Cited

U.S. PATENT DOCUMENTS

| | | | | | |
|---|---|---|---|---|---|
| 191,389 | A | * | 5/1877 | Ward et al. | 33/350 |
| 2,529,801 | A | * | 11/1950 | Fisk | 42/128 |
| 2,748,494 | A | * | 6/1956 | Raney | 33/383 |
| 2,782,511 | A | * | 2/1957 | Ivy | 42/126 |
| 5,005,308 | A | | 4/1991 | Parks | |
| 5,223,650 | A | | 6/1993 | Finn | |
| 5,315,781 | A | * | 5/1994 | Beisner | 42/125 |
| 5,406,733 | A | * | 4/1995 | Tarlton et al. | 42/119 |
| 5,630,279 | A | | 5/1997 | Slates | |
| 5,657,571 | A | | 8/1997 | Peterson | |
| 6,978,569 | B2 | | 12/2005 | Williamson, IV et al. | |
| 7,530,193 | B2 | | 5/2009 | Williamson, IV et al. | |
| 2006/0101700 | A1 | | 5/2006 | Williamson, IV et al. | |
| 2006/0162227 | A1 | | 7/2006 | Samson | |
| 2007/0175080 | A1 | | 8/2007 | Sammut et al. | |

OTHER PUBLICATIONS

Mounting Solutions Anti-Cant Device. <http://www.airgunforum.ca/forums/topic23441.html>. Sep. 14, 2008.*
Mounting Solutions Anti-Cant Device. <http://web.archive.org/web/20070524174824/http://www.junkyardgenius.com/firearms/varmint/varmint01.html>. May 24, 2007.*
Mounting Solutions Anti-Cant Device. <http://www.westernshooter.com/2008/04/acd-anti-cant-device-review.html>. Apr. 18, 2008.*

* cited by examiner

*Primary Examiner* — Gabriel Klein
(74) *Attorney, Agent, or Firm* — Michael R. Schacht; Schacht Law Office, Inc.

(57) ABSTRACT

Disclosed herein are several embodiments of a level indicator for a firearm that is configured to be repositioned from a home position, generally above the barrel of the firearm, to an extended position, generally above and to the side of the barrel of the firearm. Several different mounting apparatuses are also disclosed, as well as variations of adjustment mechanisms.

23 Claims, 14 Drawing Sheets

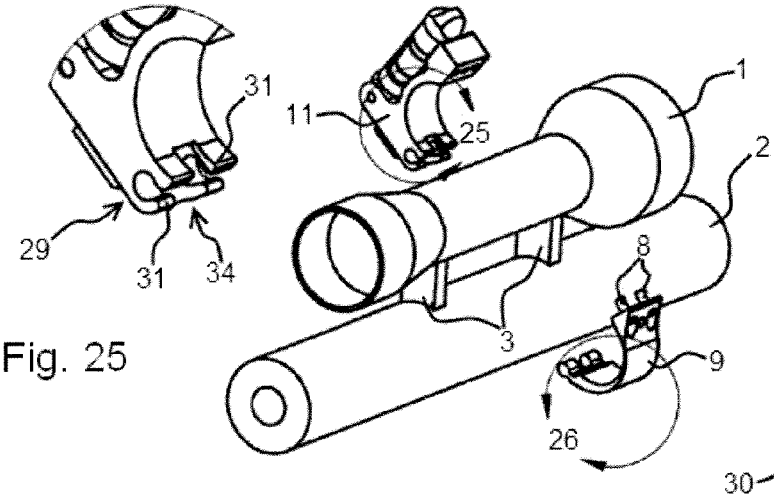
Fig. 25
Fig. 31
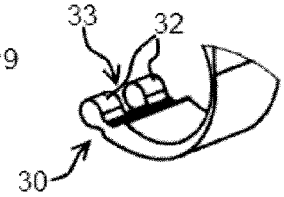
Fig. 26
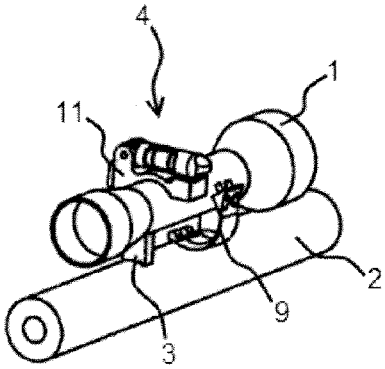
Fig. 27
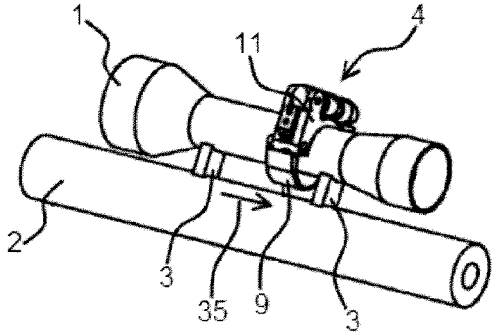
Fig. 28
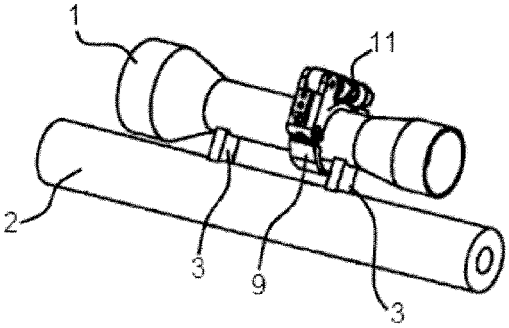
Fig. 29
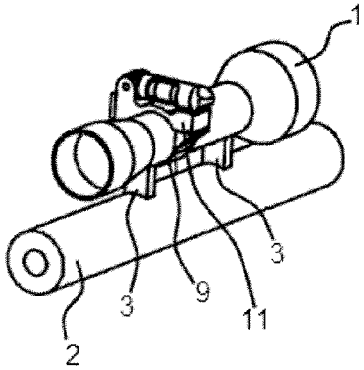
Fig. 30

SIGHT LEVEL FOR FIREARM

RELATED APPLICATIONS

This application claims priority benefit of U.S. Ser. No. 61/284,480, filed Dec. 21, 2009 and 61/403,551, filed Sep. 17, 2010.

BACKGROUND OF THE DISCLOSURE

Field of the Disclosure

This application, U.S. patent application Ser. No. 12/973,567 filed Dec. 20, 2010, claims priority benefit of U.S. Provisional Patent Application Ser. Nos. 61/284,480 filed Dec. 21, 2009, and 61/403,551 filed Sep. 17, 2010.

The contents of all related applications listed above are incorporated herein by reference.

SUMMARY OF THE DISCLOSURE

Firearms are commonly equipped with sighting apparatuses, such as aiming scopes, mounted above barrel of the firearm. These sighting apparatuses perform best when two planes are aligned. A first plane is defined by a line through the center of the gun barrel and the sight line of the scope, the first plane will be referred to as the shooting plane. A second plane is defined by a line through the center of the firearm barrel and a line perpendicular to the horizon. This second plane will be referred to as the vertical plane. Sighting apparatuses normally perform best when these two planes are coincident, or, in other words, lie in the same plane.

Reticle lines or "cross hairs" in the viewing area of common scope style sighting apparatuses facilitate alignment of the shooting plane with the vertical plane. When the sighting apparatus is installed on the firearm, it is positioned substantially on top of and centered vertically above the firearm barrel. A vertical cross hair in the sight viewing area is aligned so that an extension of the cross hair toward the gun barrel would pass through the centerline of the gun barrel. Thus, the vertical cross hair is actually a visual indicator of the shooting plane of the firearm.

By looking through the firearm scope and comparing the vertical cross hair to an object appearing in the sight known to be vertical, such as the side of a tall building, or alternately comparing the horizontal cross hair in the sight to a known horizontal object, such as the horizon above a large body of water, the user gets visual confirmation that the shooting plane is aligned with the vertical plane. This alignment is commonly called "plumb".

In many circumstances, however, a good horizontal or vertical visual reference is not available, and the firearm operator can only estimate the vertical plane. The known prior art proposes several level or plumb indicating devices to assist in finding the vertical plane. Bubble levels and electronic devices for both in-sight and out-of-sight indication are some examples and are commercially available. In-sight indicators show the reference to vertical within the viewing area of the sighting apparatus, while out-of-sight indicators show the reference to vertical outside the scope viewing area.

In-scope indicators are typically complex, expensive and can detract from the original telescopic viewing/aiming design of the sighting apparatus. Such in-scope indicators are often difficult or impossible to add to the scope after manufacture of the scope as an after-market, add-on product. Out-of-sight indicators can be complex and/or expensive, but also can have additional problems, such as being located on the scope in a poor viewing position, thus being difficult for the operator to see while shooting, or being physically unprotected from damage, especially while the firearm is being carried and not used for shooting.

Prior art out-of-sight level indicating devices are commonly attached to sighting apparatus using half round collars or straps that employ fasteners at both strap ends to connect the strap to the rest of the device. This configuration of strap and fasteners often mandates ends on the strap that are often too large to fit between many sighting apparatuses and the firearm, thus requiring the user to remove the sighting apparatus from the firearm to install the leveling/indicating device.

Removing and re-installing a sighting apparatus can be a tedious and time-consuming job; thus, it is desirable to avoid such a job when adding accessories to any sighting apparatus. When fastening any leveling device to a sighting apparatus using a strap and fastener(s), it is difficult to precisely maintain the desired relationship between the shooting plane and the leveling device. As the fasteners are tightened, the strap tends to move on the scope, thus losing the desired alignment of the leveling device.

In the field of mounting accessories to sighting apparatus, there is presently no known accessory with a provision for easily mounting additional accessories to the first accessory and sighting apparatus combination.

BRIEF DESCRIPTION OF THE DRAWINGS

FIGS. 25 & 26 show detailed views of portions of one embodiment of the disclosure in a disassembled state.

FIG. 27 shows one embodiment of the disclosure in a partially assembled state.

FIG. 28 shows the embodiment of FIG. 27 from a different angle further along in the assembly process.

FIG. 29 shows the embodiment of FIG. 28 further along in the assembly process.

FIG. 30 shows the embodiment of FIG. 29 further along in the assembly process.

FIG. 31 shows the embodiment FIGS. 25 & 26 in combination with prior art components.

DESCRIPTION OF THE PREFERRED EMBODIMENTS

Figure 1:
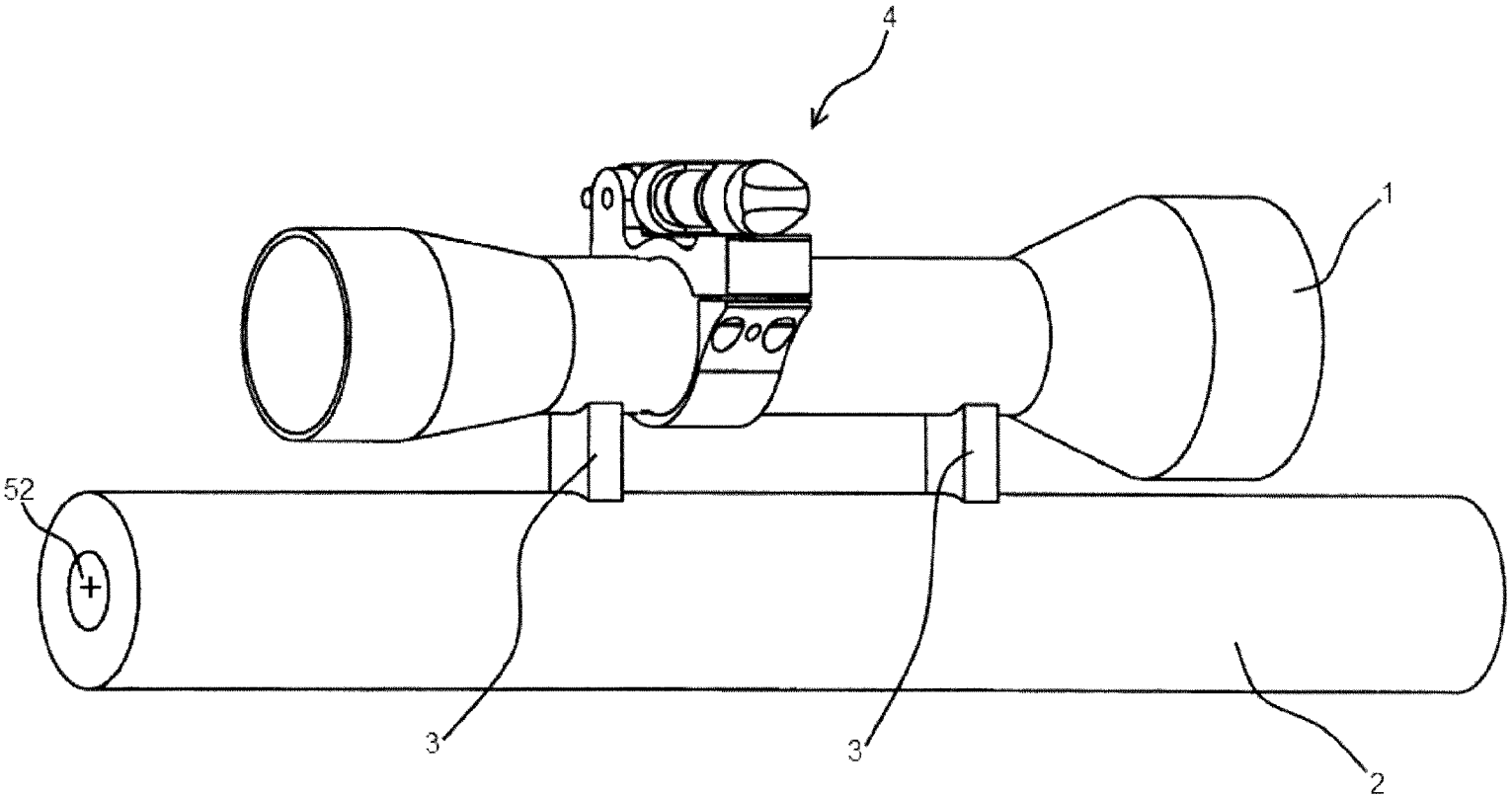
FIG. 1 is a side perspective view of one embodiment of the disclosure.

Referring to the Figs., a side view of a scope mounted above a shortened section of a firearm is shown in FIG. 1. A sighting apparatus (scope) 1 is mounted to a firearm 2 on mounts 3. In the preferred embodiment, leveling device 4 is shown mounted on scope 1. In this disclosure, the term scope is used as is substantially equivalent to the term sighting apparatus.

Reticule lines or "cross hairs" within the viewing area of the scope facilitate alignment of the shooting plane with the vertical plane. When the sighting apparatus is installed on the firearm, a vertical cross hair in the sight viewing area is aligned so that an extension of it toward the gun barrel would pass through the centerline 52 of the gun barrel. Thus, the vertical cross hair is actually a visual indicator of the shooting plane of the firearm.

In use, as previously mentioned, the firearm operator aims firearm 2 at a target while looking at the target through the scope 1, and the operator attempts to hold firearm 2 and attached scope 1 properly. By looking through the firearm scope and comparing the vertical cross hair to an object appearing in the sight known to be vertical, such as the side of a tall building, or alternately comparing the horizontal cross hair in the sight to a known horizontal object, such as the horizon above a large body of water, the user gets visual confirmation that the shooting plane is aligned with the vertical plane, or the shooting plane, what is commonly called "plumb".

As a good horizontal or vertical visual reference is often not available, without a level indicating device the firearm user can only estimate the vertical plane. With the aid of a leveling device, such as the leveling device 4 shown in FIG. 2, the user no longer has to estimate the vertical plane, as it is visually represented by an indicator on the leveling device 4. In the case of the embodiment of the leveling device 4, the indicator is a gravity driven bubble 6 in a typical bubble level vial 5, but it could alternatively be an electronic device with lights and/or audio tones as indicators that the shooting plane is plumb. Electronic indicators can be driven by liquid level sensor(s), pendulum(s) with proximity sensor(s), magnetic field sensor(s), mercury switches, or other common electronic components and circuitry.

The component of the level indicating device that actually does the sensing may be constructed to sense either horizontal or vertical planes, but for this application, the level detecting component senses the horizontal plane and is integrated into the leveling device 4 such that when the leveling device indicates a level or plumb orientation to the firearm operator, the leveling device is verifying that the shooting plane is aligned with the vertical plane. For example, the leveling device 4 in FIG. 2 contains bubble level vial 5, which indicates to the user when bubble level vial 5 is lying in a horizontal plane, by the presence of a bubble 6 appearing substantially centered between two lines 42 on bubble level vial 5. This orientation of the bubble between the lines displays that the shooting plane is aligned with the vertical plane which, as previously described, is often desired for accurate shooting. If the leveling device 4 is attached to the scope 1 such that the horizontal plane containing the long axis centerline of bubble level vial 5 is perpendicular to the shooting plane, then an indication of level in bubble level vial 5 is also an indication that the shooting plane is aligned with the vertical plane.

In some prior art examples, positioning the level above the scope may present a visual obstruction of the target or components of the scope may block viewing of the level indicating device. Prior art solutions to this problem place the level off to the side of the shooting plane. However, this arrangement leaves the level exposed to physical damage when carrying or storing the firearm. Existing leveling devices may be above or to the side of the scope, but no known embodiment is easily moved from one position to the other, giving the user the advantages of both positions.

Figure 3:
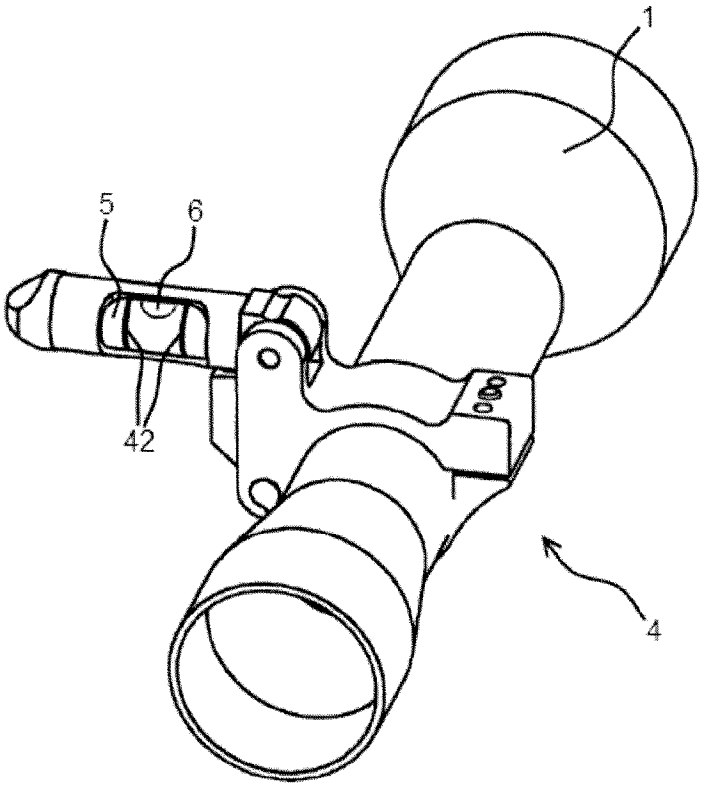
FIG. 3 is a front perspective view of the embodiment of FIG. 1 in an extended position.
Figure 2:
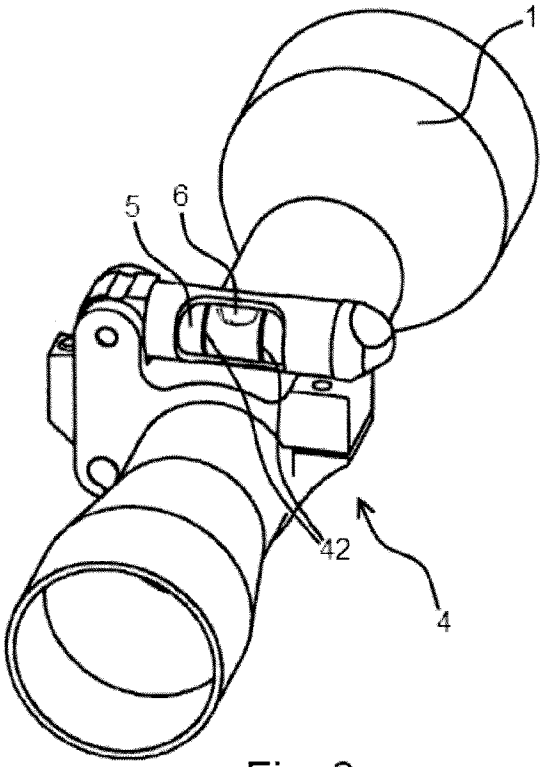
FIG. 2 is a front perspective view of the embodiment of FIG. 1 in a home position.
Figure 4:
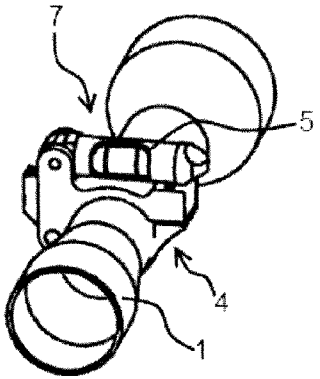
FIGS. 4-8 are front perspective views of the embodiment of FIG. 1 being repositioned from the home position of FIG. 2 to the extended position of FIG. 3.
Figure 5:
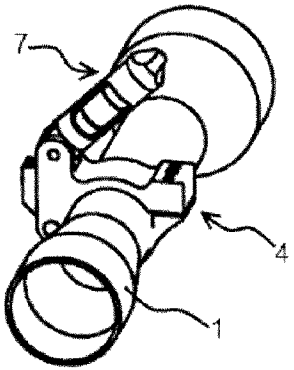
Figure 6:
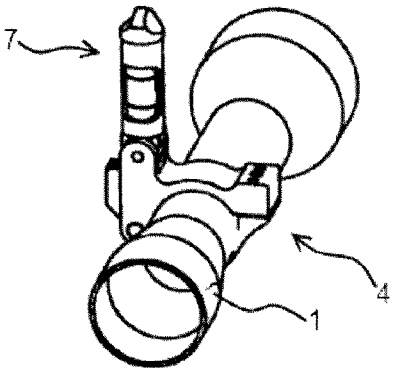
Figure 7:
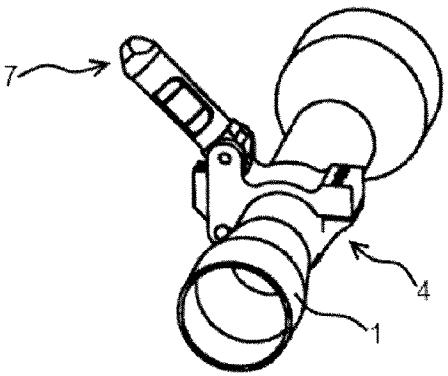
Figure 8:
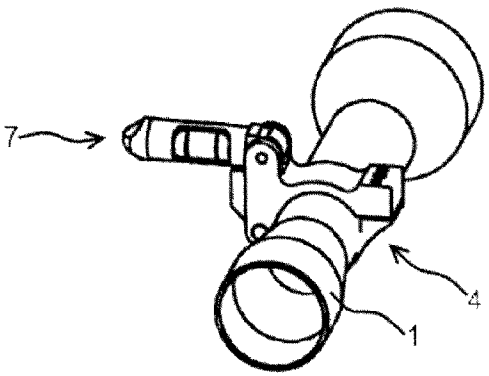

The embodiments disclosed herein have two working positions. FIG. 2 shows the indicator in the "home" position, where when the shooting axis is plumb, bubble 6 is centered between the lines 42 on bubble level vial 5, and the left-to-right center of bubble 6 lies in or near the shooting plane and above the scope 1 in an "inboard" or "home" position. FIG. 3 shows the indicator in an "outboard" or "extended" position, such that when the shooting plane is plumb, bubble 6 is substantially centered between the indicator lines 42 and the indicator is offset to one side of the shooting plane.

FIGS. 4-8 show a movable part 7 of leveling device 4 in various positions as it is moved from the home to the extended position. Note that while the Figs. show moveable part 7 and bubble level vial 5 to be two or more separate parts, it is possible to make the movable part 7 and level vial 5 as a unitary structure. Although not detailed here, it is also possible to replace the liquid filled bubble vial with electronics and display level indications by light and/or sound. Mercury or ball levels could also be equally utilized.

Figure 10:
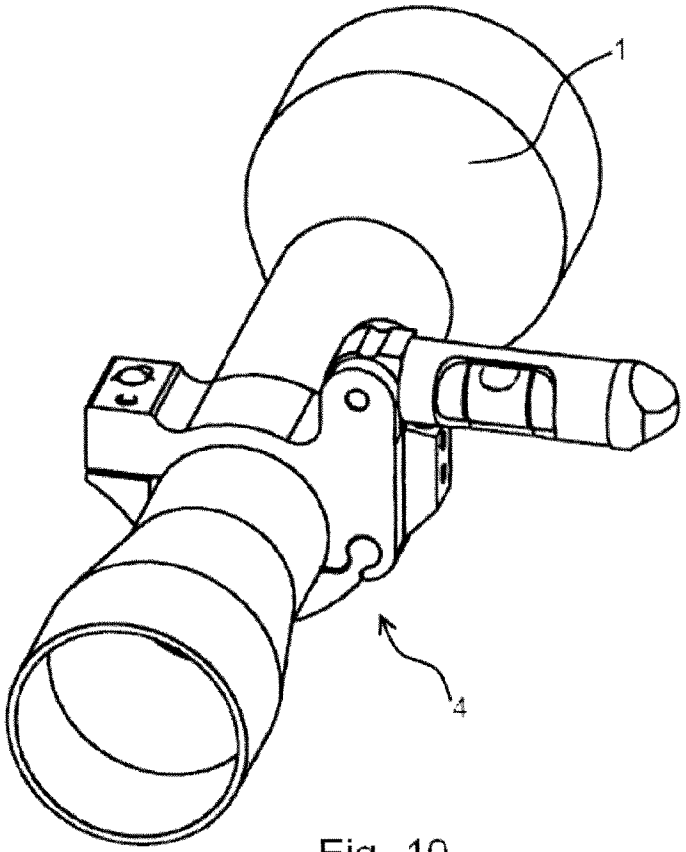
FIG. 10 is a front perspective view of the embodiment of FIG. 1 in an extended position attached to open in an opposite direction from that shown in FIG. 1.
Figure 9:
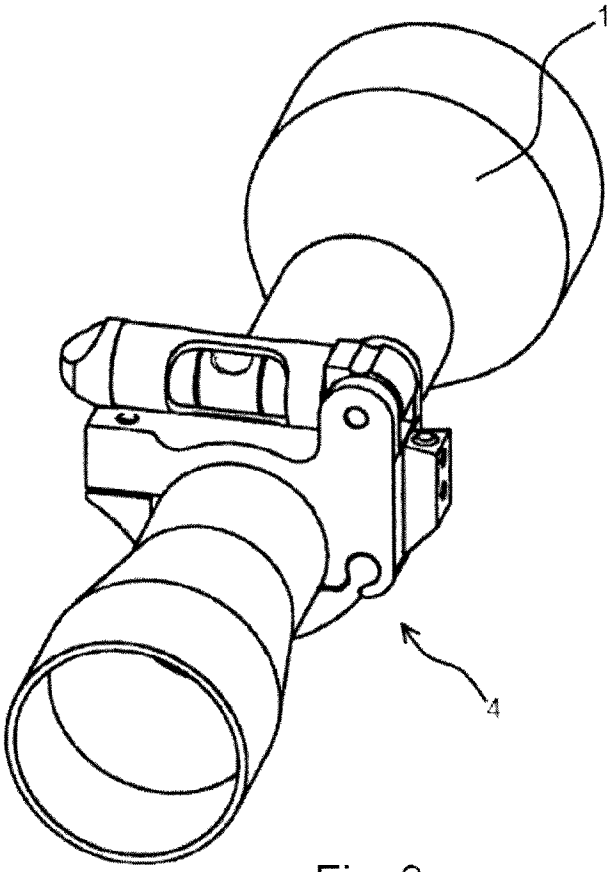
FIG. 9 is a front perspective view of the embodiment of FIG. 1 in a home position attached to open in an opposite direction from that shown in FIG. 1.

FIGS. 9 and 10 show how leveling device 4 can be installed in an extended position to accommodate users that prefer the extended position on the right side of scope 1 instead of the left, as was shown in FIG. 3. This use of this embodiment does not require any modification of leveling device 4 by the user.

The two working positions, and left and right, allow more flexibility to the operator of the leveling device 4 to match their aiming style. Further, by being able to return movable part 7 of leveling device 4 to its home position, a user reduces the possibility of physical damage to the leveling device 4 by keeping it further away from, and thus less likely to bump into, a foreign object. The home position also provides more protection to leveling device 4 by sight 1 and firearm 2 when in the home position.

Figure 12:
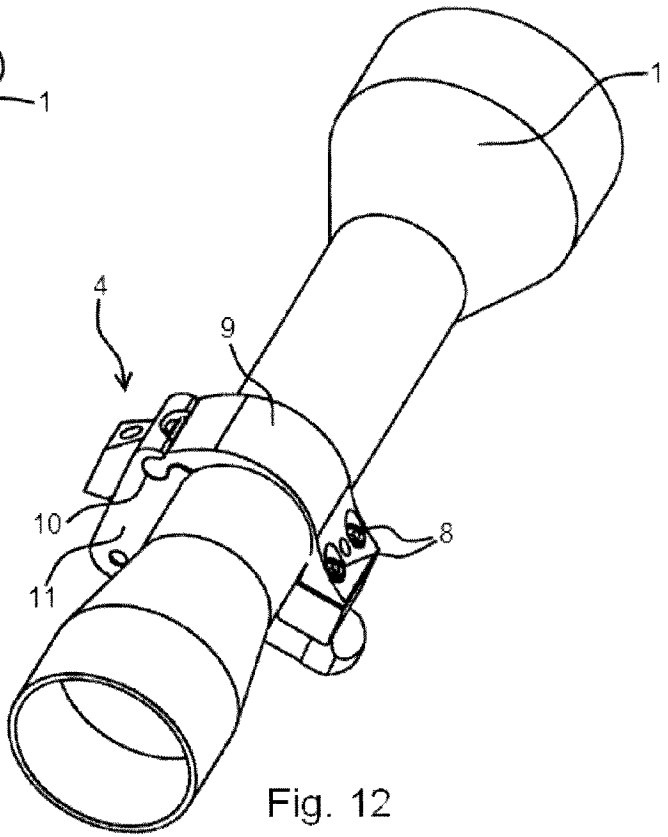
FIG. 12 is a bottom perspective view of the embodiment of FIG. 1 shown from a different angle from that shown in FIG. 11.
Figure 11:
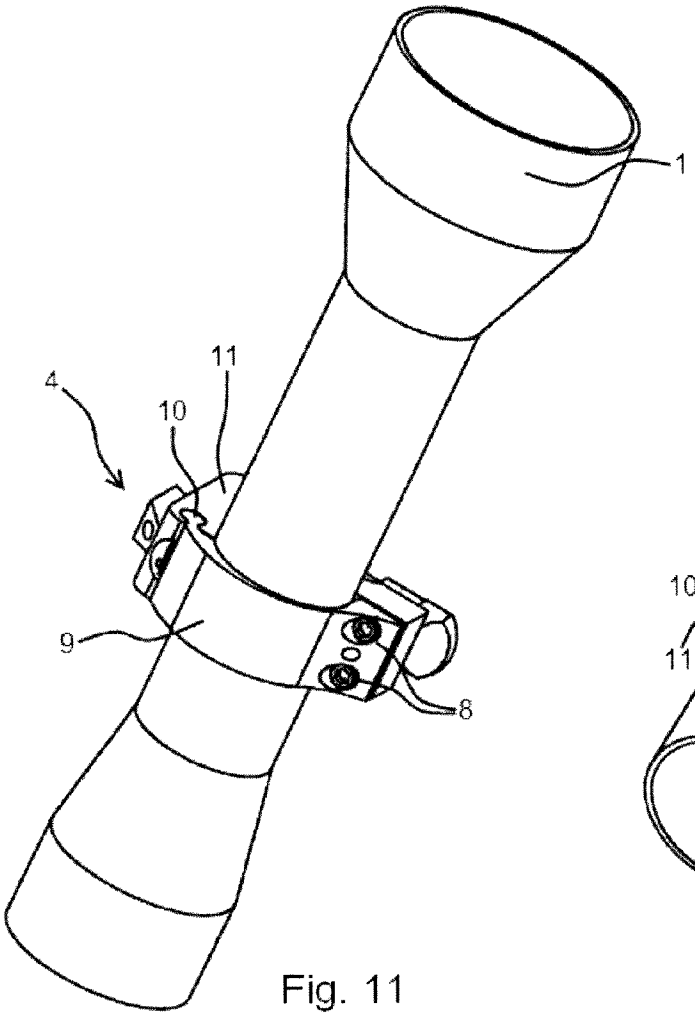
FIG. 11 is a bottom perspective view of the embodiment of FIG. 1.

Installation of the a first embodiment is simplified from prior art in that a fastener or fasteners are only required on one side of strap 9 that fastens the main body 11 of leveling device 4 to sight 1, as shown in bottom auxiliary views FIGS. 11 and 12. In this case, fasteners 8, shown at one end of strap 9, are not needed at the other end of strap 9 due to the utilization of a hinge connector 10 that connects strap 9 to the main body 11. Hinge connector 10 may be a conventional style hinge and hinge pin arrangement, or it may be a simpler device described later. If a conventional style hinge is used as hinge connector 10, it may either have a permanently installed hinge pin, or, to facilitate installation on some firearms, the hinge pin may be removable.

Although not shown in the drawings, the strap need not be a rigid member, but it could be constructed of flexible material, such as thin metal, plastic, or fabric, with end details attached or incorporated to produce the hinge effect on one end and fastening effect on the other.

A primary improvement in one embodiment over prior art is the ability to first install leveling device 4 on sight 1 in an approximately desired orientation rather than a precisely desired orientation. A secondary improvement is the ability to use apparatuses other than those previously described to attach the leveling device 4 to the scope 1, allowing a user to easily make fine adjustments to moveable part 7 to correct it to the desired, precise orientation.

Figure 15:
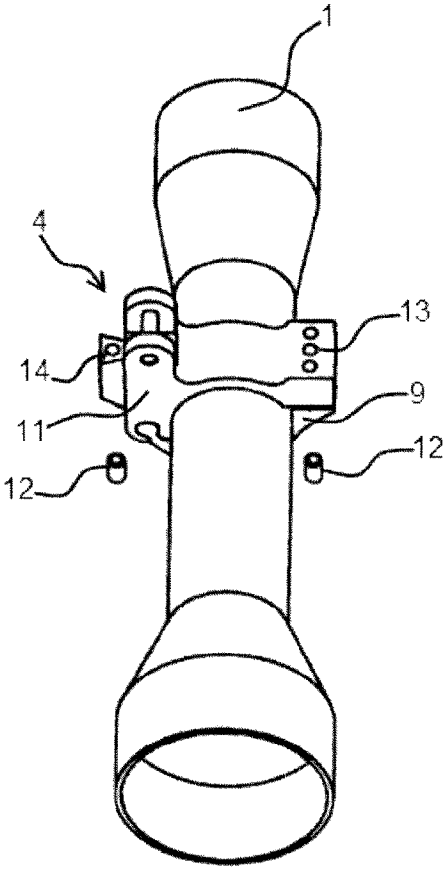
FIG. 15 is a top perspective view of the embodiment of FIG. 1 with the level indicator and adjustment mechanisms removed.
Figure 14:
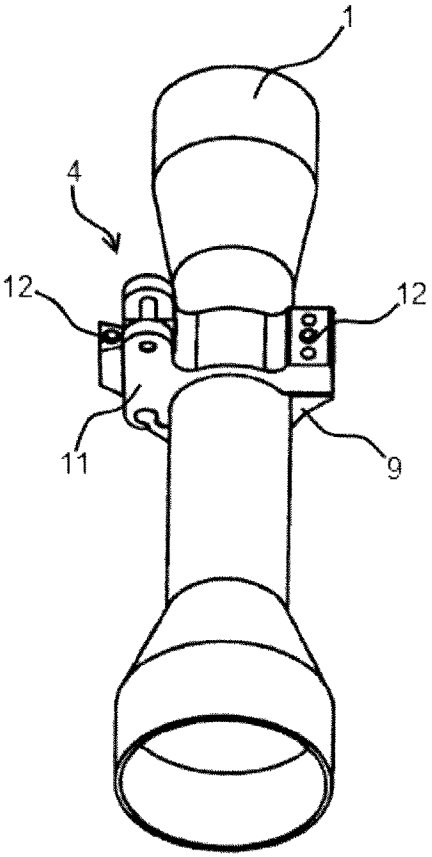
FIG. 14 is a top perspective view of the embodiment of FIG. 1 with the level indicator removed.
Figure 13:
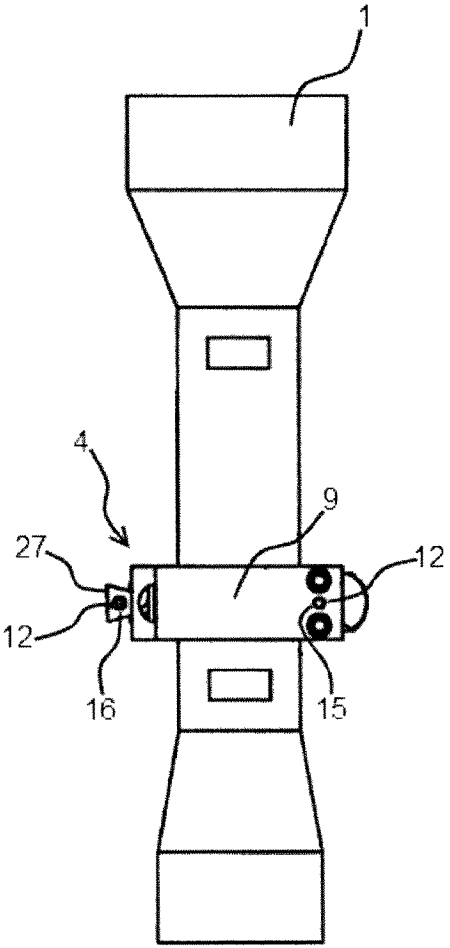
FIG. 13 is a bottom plan view of the embodiment of FIG. 1.
Figure 19:
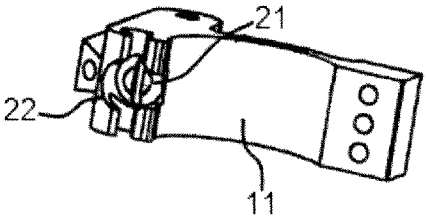
FIG. 19 is a bottom perspective view of the main body component.
Figure 20:
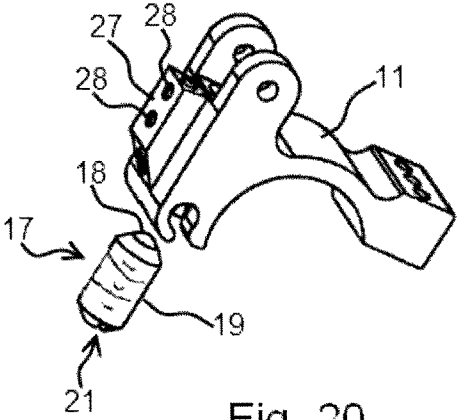
FIG. 20 is a front perspective view of the main body and compression component.
Figure 18:
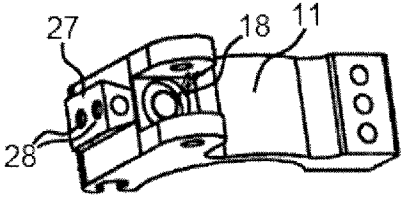
FIG. 18 is a top perspective view of the main body component.

Fine adjustment of the moveable part 7 to the desired, precise orientation can be accomplished using adjusting screws 12, as shown in FIGS. 13, 14 and 15. When moveable part 7 (omitted from FIGS. 14-15 for clarity, see FIG. 7) of leveling device 4 is in the home position, its free or non-pivoting end rests on the tip of one of the adjusting screws 12. When the movable part 7 of the leveling device 4 is in the extended position, the main body of the movable part 7 rests on the tip of the other adjustment screw 12. The screws are threaded into the main body 11 at holes 13 and 14 and in one form can be easily adjusted using a tool, such as a small screwdriver or hex key wrench, inserted into adjusting screws 12 by way of access holes 15 and 16 in strap 9.

Although screws are used for an adjusting means in the preferred embodiment, adjustments could be made in a similar fashion using cams, or wedges for the moveable part 7 to rest on, or by correctly rotating and fastening the attachment device upon the scope.

Figure 17:
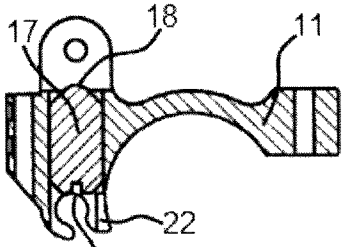
FIG. 17 is a front cutaway view of the main body and some internal components.
Figure 16:
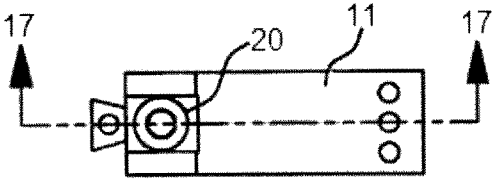
FIG. 16 is a top plan view of the main body component.

Referring to FIGS. 2, 3, 14, and 16-20, in the preferred embodiment, moveable part 7 of leveling device 4 is held in position against adjusting screws 12 by means of a commercially available spring action device called a spring plunger 17 installed in a threaded hole 20 in the main body 11. The spring plunger 17, in one form, is comprised of a rigid ball having a rigid ball surface 18 and a coil spring (not shown in the Figs.) contained within a threaded body 19. Referring to FIGS. 16 and 17, which show a top view and section view of main body 11 and spring plunger 17 respectively, and FIGS. 18-20 that show various auxiliary views of main body 11 and spring plunger 17, it can be seen how the rigid ball surface 18 and spring plunger 17 can be oriented and adjusted relative to the main body 11.

Spring plunger 17, in one form, can be adjusted by fitting a tool, such as a screwdriver or hex key, into a drive slot 21, hex hole, or other drive means on one end of spring plunger 17 and rotating threaded body 19 of the spring plunger 17 in threaded hole 20 of the main body 11 to achieve the desired force of the rigid (or semi rigid) ball surface 18 against the surface of a detent in movable part 7 (not shown in FIGS. 16-20 for clarity). Rotating threaded body 19 changes the amount of spring force against rigid ball 19, and thus, in turn, changes the force exerted upon moveable part 7. The greater the force of the ball surface 18 against the detent surface in movable part 7, the more firmly moveable part 7 snaps into position, and is held there.

Access to drive slot 21, in one form, is via an access hole 22 in the bottom side of the main body 11. This hole may be the same threaded hole 20 used to install or assemble and hold the spring plunger 17, or it could be a separate, coaxial hole of different size, as long as the access hole 22 still allows access for the adjusting tool. Spring plunger 17 is not commonly adjusted after installation of leveling device 4 on scope 1, but rather is adjusted to suit the user's preference, prior to mounting the device on scope 1.

It should be noted that while the assembly that makes up spring plunger 17 facilitates assembly and maintenance of the end product, an individual ball, spring, and screw, could be substituted in place of a spring plunger 17 without affecting how the device functions. Further, the force required to retain moveable part 7 in the home and extended positions could be alternatively attained with spring lever arms, spring washers, elastic materials or other similar means.

Figure 21:
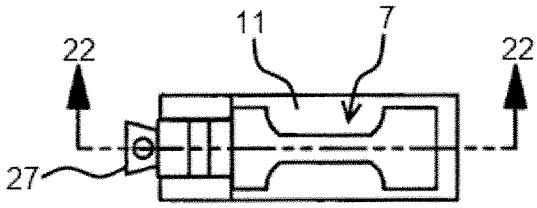
FIG. 21 is a top plan view of one embodiment of the disclosure.
Figure 22:
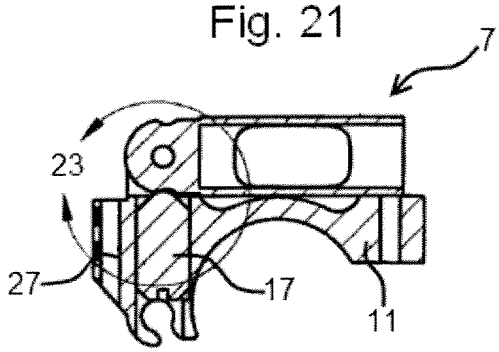
FIG. 22 is a front cutaway view of the embodiment shown in FIG. 21.
Figure 23:
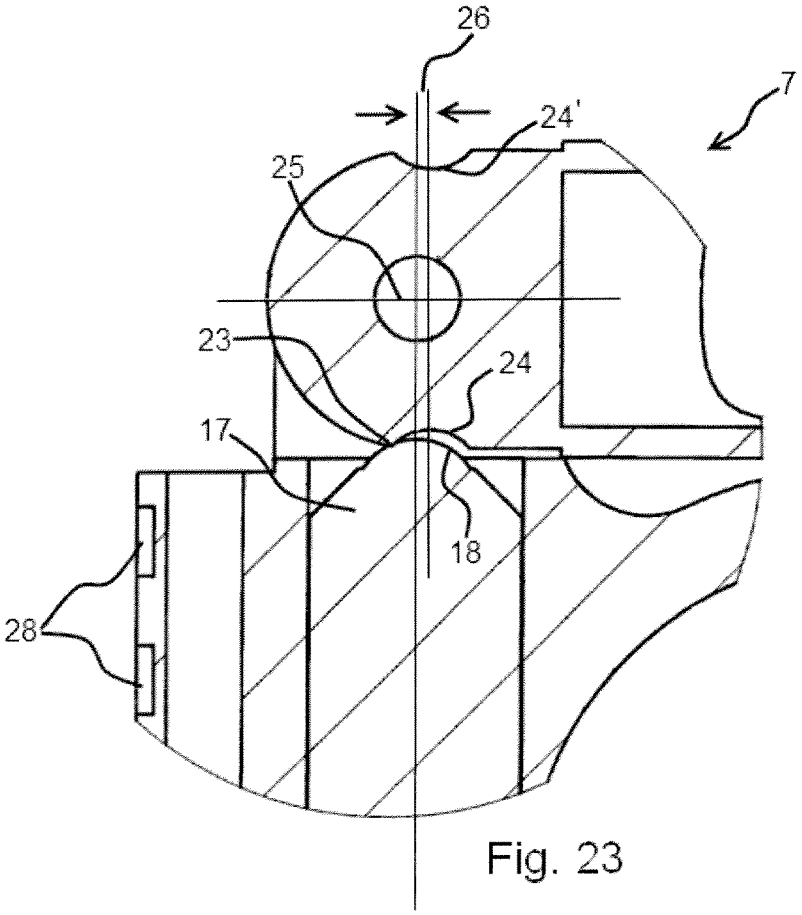
FIG. 23 is a detail view of a portion of FIG. 22.
Figure 24:
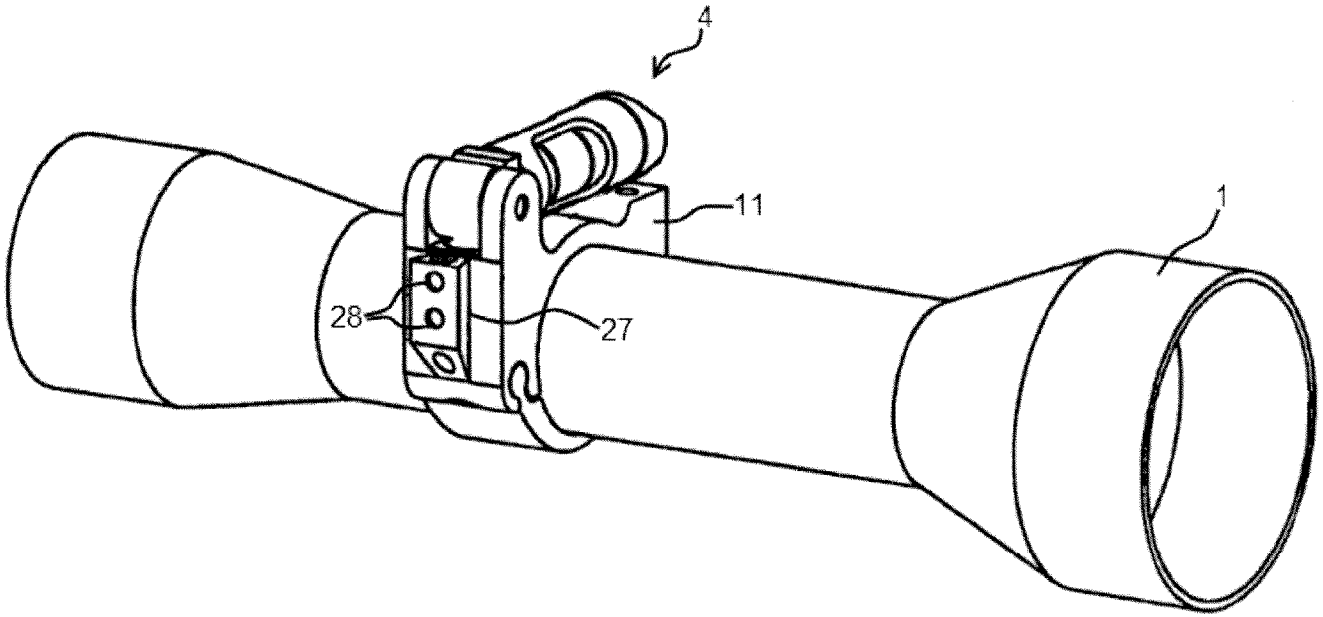
FIG. 24 is a rear perspective view of the embodiment of FIG. 9

A surprising and novel part of leveling device 4 is how the orientation of moveable part 7 and spring plunger 17 improves operational performance of the two parts, thus improving accuracy and precision of the entire leveling device 4. By locating the long axis centerline of the spring plunger 17 such that the center of the radii of the detent surfaces 24 and 24' in moveable part 7 shown in FIGS. 21-23 are of slightly off center 26 from each other, moveable part 7 snaps into the home and extended positions more positively and returns to those positions more repeatably than if the detent radii centers were located along the same long axis centerline of spring plunger 17. FIG. 23 shows how rigid ball surface 18 of the ball in spring plunger 17 contacts detent surface 24 in moveable part 7 at point 23, which has the effect of not just holding the moveable part 7 against adjusting screws 12 but actually creating a greater rotational force against movable part 7, and in turn exert force against adjusting screws 12. Further, the spring in spring plunger 17 is more compressed in this position than if it were positioned all the way into the bottom of detent surface 24, thus it produces more spring force, more rotational force, and more positive holding of moving part 7 against adjusting screws 12. The detents and ball surfaces shown are substantially spherical sections, although other shapes such as ellipses, spheroids, or functional equivalents could be used.

Another advantage of the leveling device 4, when attached to scope 1 is the ability to easily add additional shooting aids to the basic device. FIGS. 18, 20-22, and 24 show various views of an accessory mount (dovetail) 27 on the side of main body 11. While a dovetail is shown, a tee slot or other common mechanical geometry could be used, providing a member to which other devices or adaptors, such as a commercially available shooting axis angle indicator, could be easily and securely attached. In addition to the arrangement shown in the Figs., the male component could be reversed to be on the accessory or adaptor (not shown) with the female component located on the main body 11. Fastener holes and fasteners could also be substituted for dovetails. The basic design of leveling device 4 could optionally be modified to have an accessory mount on the strap 9 in addition to, or instead of, main body 11.

This quick mount accessory concept, in dovetail or other form, could be used as a stand-alone item for mounting various devices. It would be substantially what has been shown here, only with the movable part 7 and its adjusting screws 12 omitted.

A counter bore(s) 28 is positioned on dovetail 27 to provide an optional, more positive, locking means for accessories or adapters attached to main body 11. For extra security, optional fasteners can be tightened against the bottom of counter bore or counter bores 28 without any negative effects of a deformation of the dovetail 27 caused by the ends of the fasteners pushing against the base of counterbores 28, and that deformed material subsequently interfering with the removal or re-installation of components.

Hinge connector 10, in the preferred embodiment, shown assembled in FIG. 12 and disassembled in FIGS. 31, 25 and 26, has male hinge component 30 and female hinge component 29. In one form, each hinge half has two extending parts separated by a notch. Male hinge component 30 has extending parts 32 separated by notch 33, and female hinge component 29 has extending parts 31, separated by notch 34. In one form, notch 33 is at least as wide as part 32 and notch 34 is at least as wide as part 31. In optional configurations, hinge component notches 33 and 34 can be omitted, which would require more space under scope 1 for assembly of the connector 10. In one form, additional notches 33 and 34 and extending hinge parts 31 and 32 can be added, which would reduce the space required below scope 1 for positioning of the male half of the hinge connector 10. Further, male hinge component 30 could be on main body 11 instead of strap 9, and female hinge component 29 could be on strap 9 instead of main body 11, and would still function in essentially the same way.

Having half of a hinge connector 10 of this design on one end of strap 9 and its mating half on one end of main body 11 permits the small profile of the strap half of hinge connector 10 end of strap 9 to fit between scope 1 and firearm 2 so that scope 1 does not have to be removed in order to install leveling device 4. This is a significant improvement over leveling devices that have screw fasteners at both ends of their equivalent to strap 9.

The advantage of providing the notches 33 and 34 as components of the hinge connector 10 is that this arrangement allows the main body 11 and strap 9 to be assembled with less travel along the working axis of hinge connector 10, thus requiring less longitudinal space between the scope 1 and the firearm 2. This configuration accommodates scope 1 and firearm 2 arrangements that have limited room between scope mounts 3 and other components present in the center area of some models of scope 1, or other accessories attached to the center area of scope 1, and again allows installation of leveling device 4 without removing scope 1 from firearm 2.

Additional hinge notches and extending parts, such as notches 33 and 34 and extending parts 31 and 32 in FIGS. 25 and 26, can be added to further reduce the space required to assemble hinge connector 10. This adds some complexity to production of the hinge components and sacrifices a small amount of hinge connector 10 strength, but is a viable alternate design.

FIGS. 27-31 show the process of attaching a leveling device 4, in one form, to a scope 1. FIG. 31 shows main body 11 with its normally attached parts above and to one side of sight 1 and firearm 2 and strap 9 to the opposite side, each showing their typical position just prior to starting the attachment process. FIG. 27 shows main body 11 and its normally attached parts resting in position on top of scope 1 with strap 9 in position to have its narrow male hinge component end 30 inserted between scope 1 and firearm 2.

FIG. 28 shows the same components as FIG. 27 only from the opposite side of sight 1 and firearm 2, and shows hinge connector 10 now partly assembled, with one of each hinge extending part 31 and 32 positioned into hinge notches 33 and 34. FIG. 29 shows the same components again, and now shows strap 9 moved in direction of travel 35 into its working alignment with main body 11 and its free end rotated closer to scope 1. The male hinge component 30 is now interlocked with female hinge component 29. FIG. 30 shows the same components once again viewed from the original side, this time with all parts in their fully assembled position. Not visible in FIG. 30 are the now tightened fasteners 8, which appear un-tightened in FIG. 27. In FIG. 30 these fasteners are now shown connecting strap 9 to main body 11 and engaging the strap 9 around scope 1, completing the installation of leveling device 4 to scope 1.

Figure 32:
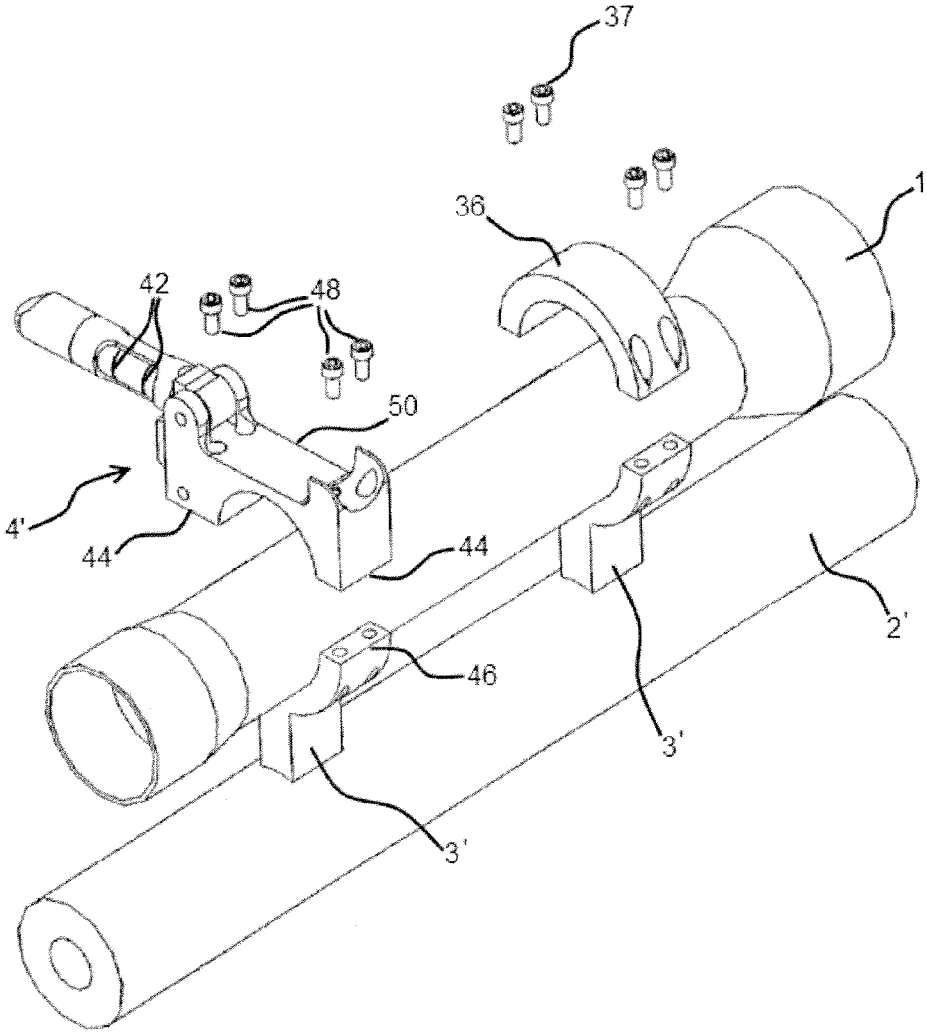
FIG. 32 shows an exploded, front perspective view of a different embodiment from that shown in FIG. 1
Figure 33:
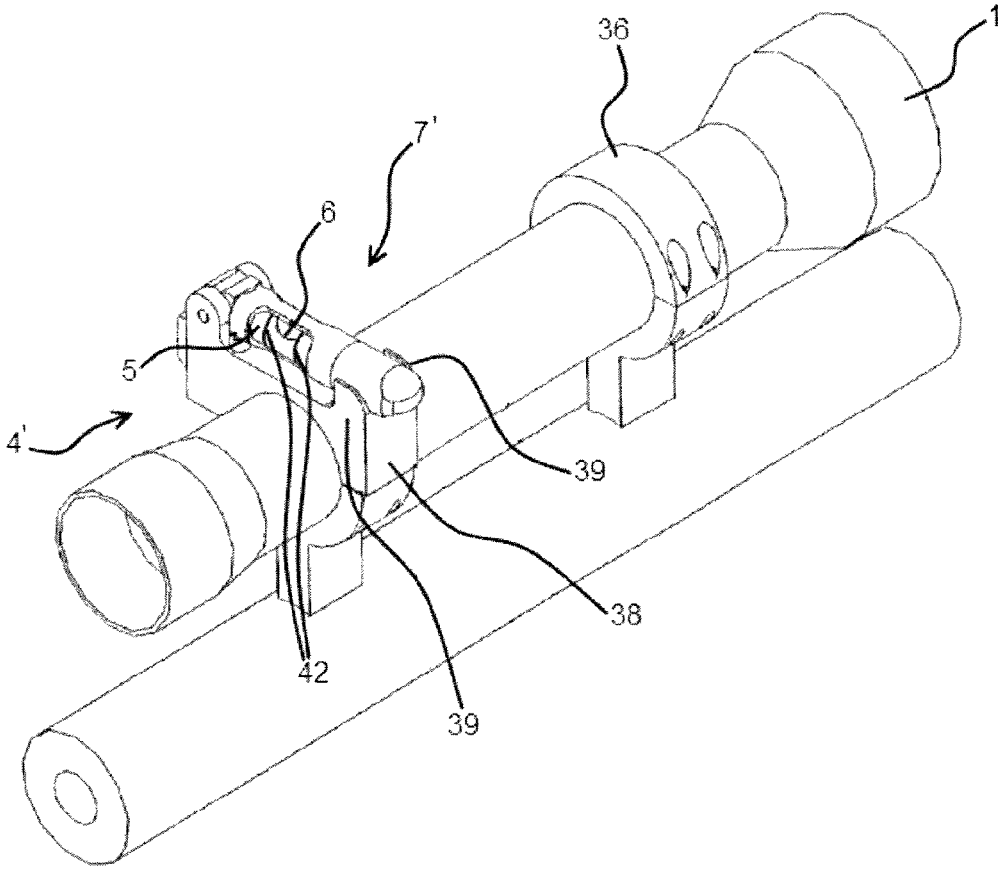
FIG. 33 shows a front perspective view of the embodiment of FIG. 32 in a home position.
Figure 34:
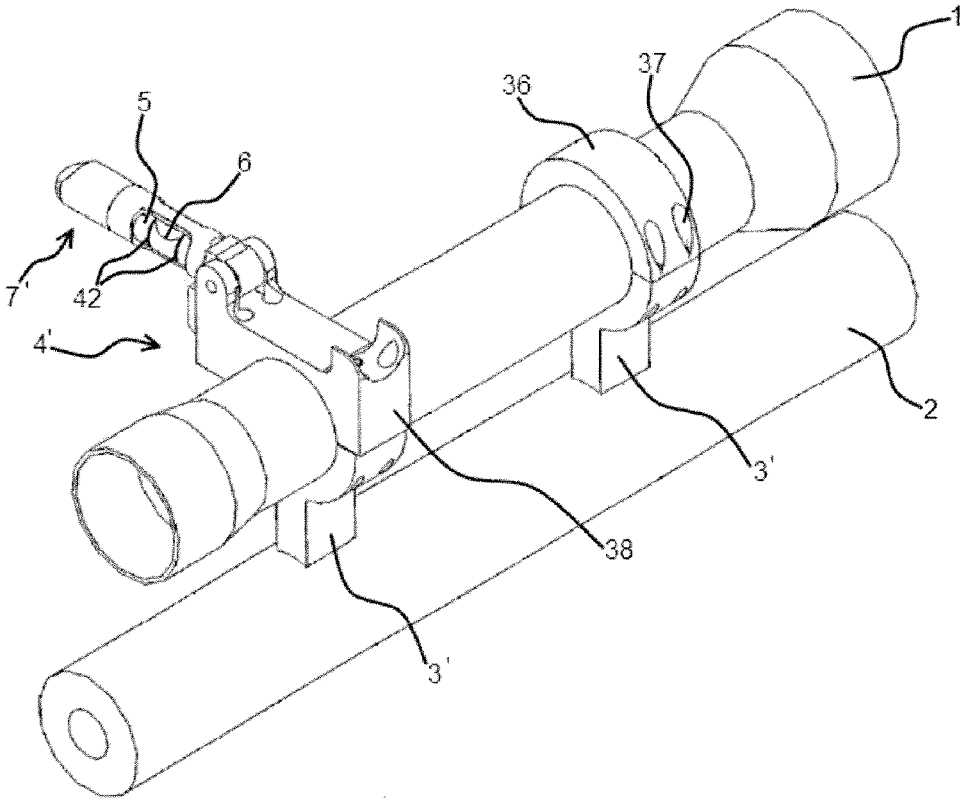
FIG. 34 shows a front perspective view of the embodiment of FIG. 33 in an extended position.
Figure 35:
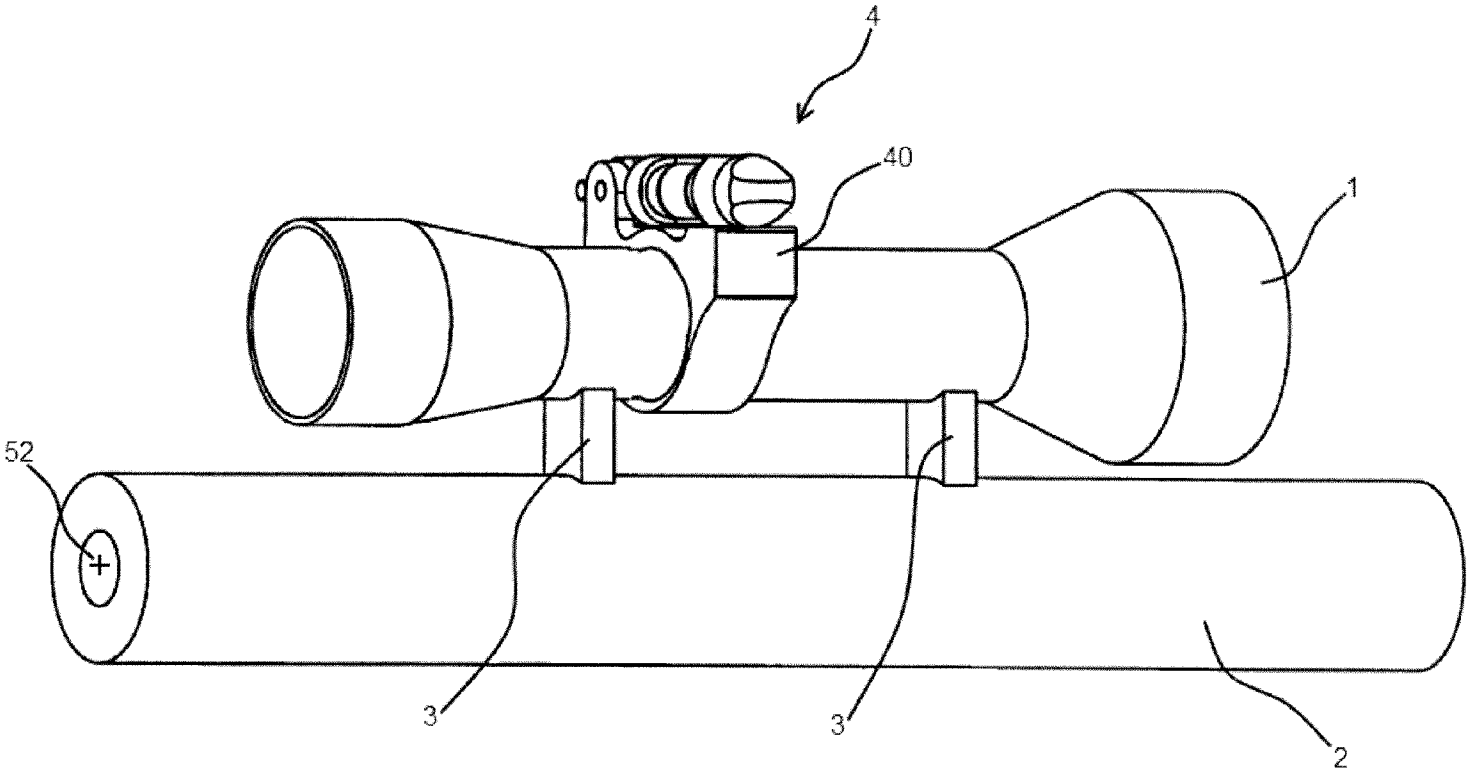
FIG. 35 is a highly schematic side perspective view of one embodiment of the disclosure.

A second embodiment is shown in FIGS. 32-34. When fastening any leveling device to a scope using a strap and fastener style connection as in the first embodiment, it may be difficult to precisely maintain the desired relationship between the shooting plane and the leveling device. However, as the fasteners are tightened, the strap and/or leveling device 4 may tend to rotate around the scope, thus losing the desired alignment of the shooting and vertical planes.

Replacing the upper half of one scope mounting bracket with a combination bracket and leveling device, as shown in the second embodiment, eliminates the problem of the strap and/or level indicator rotating around the scope during installation. In one form, the main body bracket 50 of the leveling device 4' has lowermost surfaces 44, which engage surfaces 46 of the scope mounts 3'. In another form, the surfaces 44 of the leveling device 4' do not contact the surfaces 46 of the scope mounts 3'. In this embodiment, the mounting screws 48 on either lateral side of the leveling device 4' can be alternatively tensioned or released to provide fine adjustment of the apparatus and still provide clamping force between the leveling device 4' and the scope mount 3'.

Correct alignment during installation of the level indicator can alternatively be facilitated by incorporating adjustment screws 12 into the design, as previously shown in FIG. 13. After the leveling device is attached to the scope mount, alignment is performed by turning the adjustment screws 12, or an equivalent adjustment system, to the correct orientation.

This embodiment is enhanced by two primary components: one component clamps the scope and leveling device 4' to the scope mount 3', and the other component provides the leveling function. The leveling component is connected to the clamping component at a pivot similar to that of the first embodiment, which allows the leveling component to be used in two positions, either extended or home. The level indicator can be positioned either above the scope (home position) or off to the side (extended position). The operator has a choice of which lateral side the level can be opened to when the device is installed on the scope mount. This choice of left or right sides gives the operator a third working position to choose from (right extended, left extended, or home).

Referring to FIG. 32, a perspective view of a sighting apparatus (scope 1) partially mounted above a shortened section of a firearm 2' is shown. The scope 1 is sitting in the lower scope mounts 3' of the firearm 2'. In the preferred embodiment, a leveling device 4' is shown above one of the lower scope mounts 3' on scope 1. FIG. 32 also shows a typical upper scope mount 36 and the mounting screws 37 used to attached either the upper scope mount 36 or the leveling device 4' to the lower scope mounts 3'. While two mounting screws 37 are shown for each side of the lower scope mounts 3', one, three or more could be used, as well as various other common fasteners, hinge type joints, or equivalents.

FIG. 34 shows the leveling device 4' and the upper scope mount 36 in their normally installed positions. The upper scope mount 36 and a stationary part 38 of the leveling device 4' are held in place by the mounting screws 37, which are now recessed into counterbores and are mostly hidden from view. In this view, a bubble vial 5 contained within and partially protected by a moveable part 7' is shown in its extended position. A bubble 6 in the bubble level vial 5 shows the user when the bubble level vial 5 is in a level position when the bubble 6 is centered between two indicator lines 42 on the bubble level vial 5.

FIG. 33 shows the moveable part 7' of leveling device 4' in its home position above the scope 1. In this home or closed position, the bubble 6 can still be used to indicate when the bubble level vial 5 is level, which in turn, with the leveling device 4' properly adjusted, indicates that the shooting plane is vertical.

The leveling device of either the first or the second embodiment can be adjusted after installation to ensure the leveling device indicates level when the shooting plane is vertical. This is accomplished by first positioning the firearm so that its shooting plane is vertical, then checking that the bubble 6 is centered between the lines 42 on the bubble level vial 5. If the bubble 6 is not centered, an adjustment/stop screw 12 shown in FIG. 13 is provided to facilitate centering the bubble 6. In one form, two separate adjusting/top screws are incorporated in one embodiment, one for the extended or open position and one for the home position. Adjustments can then be made in either the open or home positions, or in both. The movable part 7' in one form rests on the end of one of the adjustment/stop screws, which acts as a stop for the travel of the movable part 7' in the home position. In FIG. 32, the movable part 7' rests on the end of the adjustment stop screw, just outboard of the pivot point, and performs the same function in the extended position.

In use, a firearm user aims firearm 2 at a target while looking at the target through scope 1, and attempts to hold firearm 2 and scope 1 (that define the shooting plane) so that the shooting plane is vertical. With the leveling device 4' installed, the user no longer has to estimate the vertical plane, as it is visually represented by the gravity driven bubble 6 in leveling device 4'.

As with the first embodiment, the second embodiment in one form has two working positions. FIG. 33 shows the basic "home" or "closed" position, where when the shooting axis is plumb, bubble 6 is centered between the lines 42 on bubble level vial 5. While it may be convenient to have the left-to-right center of bubble 6 approximately in the shooting plane and above the scope 1, the bubble level vial can be off-center and still function properly as a level indicator while in the protected "home" or "closed" position. FIG. 34 shows the "extended" or "open" position, where when the shooting plane is plumb, bubble 6, when centered between the lines 42, indicates the shooting plane is plumb or vertical.

The three working positions, top, left and right, allow more flexibility to the user of leveling device 4' to match their aiming style. Further, the ability to return movable part 7' of leveling device 4' to its home or closed position reduces the possibility of physical damage to the leveling device 4' by keeping it further away from, and thus less likely to bump into, a foreign object. It is also provided more protection by shielding by the sight 1 and firearm 2 when in the home position. In addition, further physical protection may be provided to moveable part 7' in the closed position by two guard arms 39 protruding upward from stationary part 38 on either side of the free end of the moveable part 7'.

In one embodiment, the sight level is incorporated into the sighting apparatus, and is not removably attached thereto. In this embodiment, the main body 40 is incorporated as a part of the sighting apparatus 1. This embodiment of a sighting level may be glued, welded, taped, or otherwise permanently incorporated with the scope.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore we claim:

1. A sight level for a firearm assembly comprising a firearm and a sighting apparatus defining a sight line, where the firearm comprises a barrel having a bore defining a centerline and the centerline and the sight line define a shooting plane, the sight level comprising:

a main body and a strap, where the main body defines a first hinge part and a fastening portion, where the first hinge part defines a first notch, and the strap defines a second hinge part defining a second notch, the first notch is configured such that a portion of the second hinge part may pass through the first notch, and the second notch is configured such that a portion of the first hinge part may pass through the second notch; and a level indicator operatively coupled to the main body for rotation about a rotation axis; wherein the sight level is detachably attachable to the sighting apparatus by passing a portion of the second hinge part through the first notch while passing a portion of first hinge part through the second notch and then displacing one of the main body and the strap along a line parallel to the sight line defined by the sighting apparatus relative to the other of the main body and the strap such that the first and second hinge parts interlock; and when the sight level is attached to the sighting apparatus, the main body and the strap are configured to engage the sighting apparatus such that the rotation axis is substantially parallel to the centerline, the level indicator rotates about the rotation axis between a home position in which the level indicator lies at least partly within shooting plane, and an extended position in which the level indicator is spaced from the shooting plane, and the level indicator is spaced vertically above the sighting apparatus in the home position and in the extended position.

2. A sight level as recited in claim 1, in which the level indicator indicates an angular orientation of the firearm when in the extended position.

3. A sight level as recited in claim 1, in which the level indicator indicates an angular orientation of the firearm when in the extended position and when in the home position.

4. A sight level as recited in claim 1, in which the sight level further comprises at least one pivot stop operably configured to determine at least one of the home and extended positions.

5. A sight level as recited in claim 4, in which the at least one pivot stop is adjustable to allow adjustment of at least one of the home and extended positions.

6. A sight level as recited in claim 4, in which the at least one pivot stop comprises first and second pivot stops that allow adjustment of the home and extended positions, respectively.

7. A sight level as recited in claim 1, in which the level indicator comprises a fluid filled bubble level.

8. A sight level as recited in claim 1, in which;

the strap defines a first end and a second end defining a second hinge part;

the strap is sized and dimensioned to fit between the firearm and the sighting apparatus while the sighting apparatus is mounted on the firearm;

the first hinge portion and the second hinge portion form a hinge connector that secures the second end of the strap to the main body;

the fastener extends through the first end of the strap to secured the first end of the strap to the fastening portion of the main body; and the main body and the strap are configured to frictionally engage the first and second portions of the sighting apparatus to detachably attach the sight level to the sighting apparatus.

9. A sight level as recited in claim 1, in which the level indicator is vertically above the bore of the firearm in the home position; and horizontally offset from the bore of the firearm in the extended position.

10. A sight level as recited in claim 4, in which the at least one pivot stop is formed by at least one set screw supported by the main body.

11. A sight level for a firearm assembly comprising a firearm and a sighting apparatus defining a sight line, where the firearm comprises a barrel having a bore defining a centerline and the centerline and the sight line define a shooting plane, the sight level comprising:

a main body defining a female hinge part and a fastening portion;

a level indicator operatively coupled to the main body for rotation about a rotation axis; and a strap having a first end and a second end defining a male hinge part; wherein the second end of the strap is sized and dimensioned such that the second end of the strap fits between the firearm and the sighting apparatus while the sighting apparatus is mounted on the firearm and with the strap between the firearm and the sighting apparatus, the strap is movable relative to the main body along a line parallel to the sight line such that the female hinge part receives the male hinge part to form a hinge connector that secures the second end of the strap to the main body;

the first end of the strap is adapted to be secured to the fastening portion of the main body; and with the hinge connector formed and the first end of the strap secured to the fastening portion of the main body, the main body and the strap frictionally engage opposing portions of the sighting apparatus to detachably attach the level indicator to the sighting apparatus such that the rotation axis is substantially parallel to the centerline, and the level indicator rotates between a home position in which at least part of the level indicator lies within the shooting plane, and an extended position in which the level indicator is spaced from the shooting plane.

12. A sight level as recited in claim 11, further comprising at least one pivot stop operably configured to determine at least one of the home and extended positions.

13. A sight level as recited in claim 12, in which the at least one pivot stop comprises first and second pivot stops that allow adjustment of the home and extended positions, respectively.

14. A sight level as recited in claim 11, in which the level indicator is:

vertically above the bore of the firearm in the home position; and horizontally offset from the bore of the firearm in the extended position.

15. A sight level for a firearm assembly comprising a firearm and a sighting apparatus defining a sight line, where the firearm comprises a barrel having a bore defining a centerline and the centerline and the sight line define a shooting plane, the sight level comprising:

a main body defining a rotation axis; and a level indicator operatively coupled to the main body for rotation about the rotation axis, where the level indicator defines first and second locator notches; and a spring plunger supported by the main body to apply a biasing force to the level indicator along a biasing axis; wherein the main body is adapted to be supported relative to the sighting apparatus such that the rotation axis is substantially parallel to the centerline, the level indicator rotates about the rotation axis between a home position in which the level indicator lies at least partly within shooting plane, and an extended position in which the level indicator is laterally spaced from the shooting plane, the level indicator is vertically above the bore of the firearm in the home position; and horizontally offset from the bore of the firearm in the extended position, and the first and second locator notches are arranged relative to the biasing axis such that the biasing force applied by the spring plunger rotates the level indicator into the home position and the extended position.

16. A sight level as recited in claim 15, in which the sight level further comprises at least one pivot stop operably configured to determine at least one of the home and extended positions.

17. A sight level as recited in claim 16, in which the at least one pivot stop comprises first and second pivot stops that allow adjustment of the home and extended positions, respectively.

18. A sight level as recited in claim 15, in which: the first and second locator notches are arranged relative to the biasing axis such that the biasing force applied by the spring plunger against the first locator notch forces the level indicator into the home position; and the biasing force applied by the spring plunger against the second locator notch forces the level indicator into the extended position.

19. A sight level for a firearm assembly comprising a firearm and a sighting apparatus defining a sight line, where the firearm comprises a barrel having a bore defining a centerline and the centerline and the sight line define a shooting plane, the sight level comprising:

a main body;

a level indicator operatively coupled to the main body for rotation about a rotation axis, where the level indicator defines first and second locating portions;

first and second pivot stops supported by the main body; and a plunger supported by the main body and configured to apply force on the level indicator; wherein the main body is adapted to be supported relative to the sighting apparatus such that the rotation axis is substantially parallel to the centerline, the level indicator rotates about the rotation axis between a home position in which the level indicator lies at least partly within shooting plane, and an extended position in which the level indicator is laterally spaced from the shooting plane, the level indicator is vertically above the bore of the firearm in the home position; and horizontally offset from the bore of the firearm in the extended position, the first pivot stop defines the home position, the second pivot stop defines the extended position, and the plunger and the first and second locating portions are configured relative to each other such that the plunger engages the first locating portion to rotate the level indicator against the first pivot stop when the level indicator is in the home position; and the plunger engages the second locating portion to rotate the level indicator against the second pivot stop when the level indicator is in the extended position.

20. A sight level as recited in claim 19, in which the first and second pivot stops are defined by first and second set screws, respectively, where rotation of the first and second set screws adjust the home and extended positions, respectively.

21. A sight level as recited in claim 19, in which the sight level further comprises a strap, wherein:

the main body defines a first hinge part and a fastening portion;

the strap defines a first end and a second end defining a second hinge part;

the strap is sized and dimensioned to fit between the firearm and the sighting apparatus while the sighting apparatus is mounted on the firearm;

the first hinge portion and the second hinge portion form a hinge connector that secures the second end of the strap to the main body;

the first end of the strap is adapted to be secured to the fastening portion of the main body; and the main body and the strap are configured to frictionally engage opposing portions of the sighting apparatus to detachably attach the sight level to the sighting apparatus.

22. A combination as recited in claim 1, in which the sight level further comprises a plunger supported by the main body and configured to apply force on the level indicator in the home position.

23. A sight level as recited in claim 11, further comprising a plunger supported by the main body and configured to apply force on the level indicator in the home position.

* * * * *